US008820600B2

(12) United States Patent
Haselwander

(10) Patent No.: US 8,820,600 B2
(45) Date of Patent: Sep. 2, 2014

(54) ACCUMULATOR WITH TENSIONING DEVICE

(75) Inventor: John (Jack) Haselwander, Ooltewah, TN (US)

(73) Assignee: Beaulieu Group, LLC, Dalton, GA (US)

( * ) Notice: Subject to any disclaimer, the term of this patent is extended or adjusted under 35 U.S.C. 154(b) by 415 days.

(21) Appl. No.: 13/346,745

(22) Filed: Jan. 10, 2012

(65) Prior Publication Data

US 2012/0181367 A1 Jul. 19, 2012

Related U.S. Application Data

(60) Provisional application No. 61/432,305, filed on Jan. 13, 2011.

(51) Int. Cl.

| | |
|---|---|
| ***B65H 59/10*** | (2006.01) |
| ***B65H 51/20*** | (2006.01) |
| ***D02J 13/00*** | (2006.01) |
| ***B65H 59/00*** | (2006.01) |

(52) U.S. Cl.

CPC ..... *B65H 51/20* (2013.01); *B65H 2701/31* (2013.01); *D02J 13/001* (2013.01); *B65H 59/00* (2013.01)

USPC ..... 226/4; 226/118.4; 242/364.6; 242/366.3; 242/418.1; 242/147 R

(58) Field of Classification Search

USPC ..... 226/118.4, 4, 118.3; 242/552, 364.6, 242/364.7, 364.8, 366.3, 417–417.3, 418.1, 242/147 R

See application file for complete search history.

(56) References Cited

U.S. PATENT DOCUMENTS

| | | | |
|---|---|---|---|
| 2008/0163470 | A1 | 7/2008 | Mazoyer et al. |
| 2008/0164360 | A1 | 7/2008 | Mazoyer |

*Primary Examiner* — William E Dondero

(74) *Attorney, Agent, or Firm* — Sutherland Asbill & Brennan LLP

(57) ABSTRACT

The present application provides a yarn accumulator for use with a yarn sausage in a heat setting line. The yarn applicator may include a sled in contact with the yarn sausage and a tensioning device in communication with the sled. The tensioning device applies a variable tension to the sled based upon the length of the yarn sausage. The tensioning device may include a sled pulley in communication with the sled, a ratioed pulley set in communication with the sled pulley, a counterweight pulley in communication with the ratioed pulley set, and a counterweight in communication with the counterweight pulley.

20 Claims, 4 Drawing Sheets

--Prior Art--

--Prior Art--

ACCUMULATOR WITH TENSIONING DEVICE

RELATED APPLICATIONS

The present application claims priority to U.S. Provisional Application Ser. No. 61/432,305, filed on Jan. 13, 2011. U.S. Provisional Application Ser. No. 61/432,305 is incorporated herein by reference in full.

TECHNICAL FIELD

The present application relates generally to textile equipment and more particularly relates to a yarn accumulator with a controlled tensioning device for use with a heat setting line and the like.

BACKGROUND OF THE INVENTION

Yarn and other types of fibers used in the textile industry for carpeting and the like may be produced in part within a heat setting machine. Heat setting is a thermal process that gives yarn and other types of fibers dimensional stability, diminished torque, higher volume, wrinkle resistance, temperature resistance, and other desired properties. Due to the varying speeds of the several components within a typical heat setting line, an intermediate yarn accumulator may be used therein. For example, yarn may be pulled from a heat setting tunnel and fed onto the yarn accumulator in the form of a yarn sausage, i.e., an expanding or contracting mass of yarn in any form. In turn, a winder later pulls the yarn from the accumulator and winds the yarn onto bobbins and the like. The heat setting tunnel may operate in a substantially continuously fashion while the winder may operate intermittently so as to change bobbins as needed.

A rolling sled within the accumulator may compress the yarn sausage as it is being formed. The sled generally is weighted so as to make the yarn run efficiently towards the winder. The amount of weight generally is determined when the yarn sausage is first formed. The length of the yarn sausage, however, will vary during operation. If the pressure applied to the yarn sausage is not varied accordingly, the yarn may be pulled out of the accumulator in an uneven manner and thus may cause low efficiency at the winder. Although various types of sled tensioning devices are known, these devices generally use various types of electronics and other types of complex controls.

There is a desire therefore for a simplified but efficient tensioning device for a yarn accumulator so as to apply the appropriate tension to a yarn sausage during all stages of operation. Such a tensioning device may provide variable tension on the yarn sausage for high efficiency in feeding the yarn to a winder. Other types of linear fed devices also may be used herein.

SUMMARY OF THE INVENTION

The present application and the resultant patent thus provide a yarn accumulator for use with a yarn sausage in a heat setting line. The yarn applicator may include a sled in contact with the yarn sausage and a tensioning device in communication with the sled. The tensioning device applies variable tension to the sled based upon the length of the yarn sausage. The tensioning device may include a sled pulley in communication with the sled, a ratioed pulley set in communication with the sled pulley, a counterweight pulley in communication with the ratioed pulley set, and a counterweight in communication with the counterweight pulley.

The present application and the resultant patent further provide a method of maintaining a force on a yarn sausage in a yarn accumulator. The method may include the steps of positioning a sled about the yarn sausage, expanding a length of the yarn sausage, pushing the sled in a first direction by the expanding length of the yarn sausage, pulling a first pulley of a ratioed pulley set by the sled pushed in the first direction, pulling a second pulley of the ratioed pulley set by a pulley coil in communication with the first pulley, raising a counterweight by the second pulley, and pulling the sled in a second direction so as to maintain the force on the yarn sausage as the counterweight rises.

The present application and the resultant patent further provide a yarn accumulator for use with a yarn sausage in a heat setting line. The yarn accumulator may include a sled in contact with the yarn sausage and a tensioning device in communication with the sled. The tensioning device may include a ratioed pulley set and a counterweight such that the tensioning device applies a variable tension to the sled based upon a length of the yarn sausage.

These and other features and improvements of the present application will become apparent to one of ordinary skill in the art upon review of the following detailed description when taken in conjunction with the several drawings and the appended claims.

DETAILED DESCRIPTION

Figure 1:
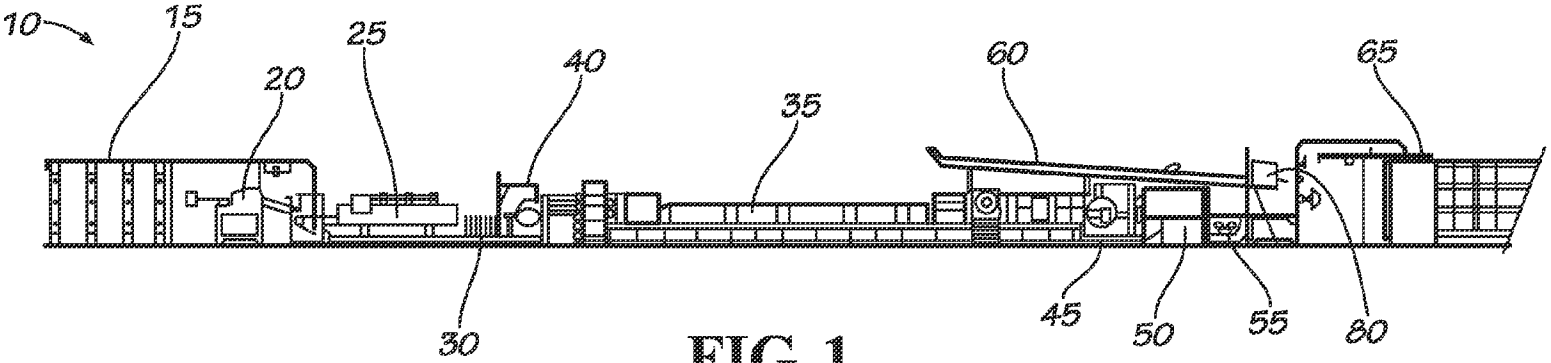
FIG. 1 is a side plan view of a known heat setting line and the components therein.

Referring now to the drawings, in which like numerals reflect like elements throughout the several views, FIG. 1 shows a known heat setting line 10. The heat setting line 10 may be continuously fed yarn or other fibers by a creel 15. The yarn then may be coiled and may be conveyed through a steamer 25 and a cooler 30. Depending upon the type of fibers used, the yarn may shrink in the steamer 25 so as to provide bulk. The yarn then may pass into a heat setting tunnel 35. The heat setting tunnel 35 may be pressurized and may have an inlet head 40 and an outlet head 45. The inlet and outlet heads 40, 45 may have a number of rollers therein so as to provide constant and regular pressure. In the heat setting tunnel 35, the yarn undergoes a thermal shock due to saturated steam under high pressure and high temperature so as to set the fibers. The yarn then may pass through a dryer 50 and a further cooler 55. The yarn then may be stored on an accumulator 60 before being wound on bobbins in a winder 65. Other components and other configurations may be used herein.

Figure 2:
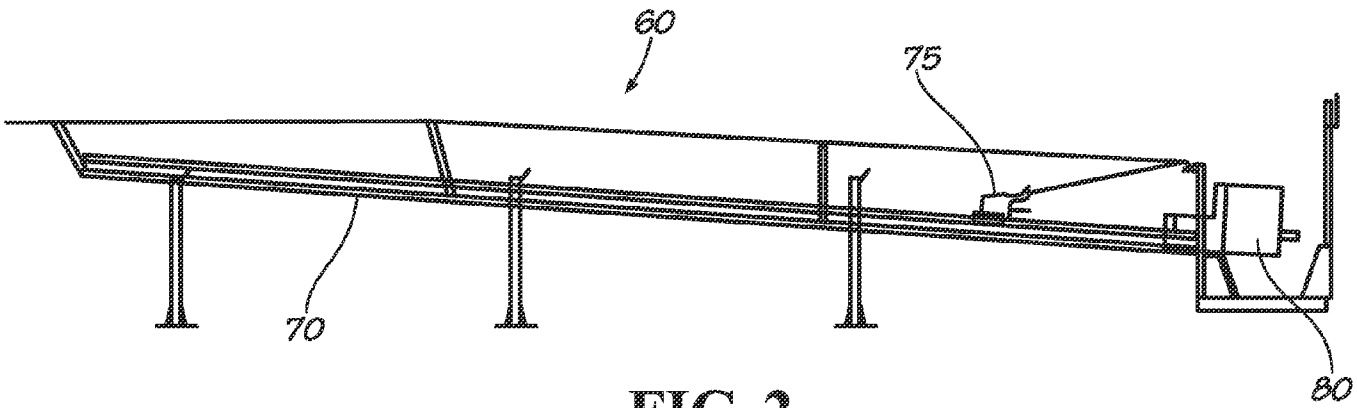
FIG. 2 is a side plan view of a known yarn accumulator.

FIG. 2 shows an example of the accumulator 60 in more detail. As is shown, the accumulator 60 may include a chute 70 with a sled 75 sliding therein. A pull roller 80 may be positioned on one end of the chute 70. The pull roller 80 pulls the yarn from heat setting tunnel 35 and forms the yarn sausage within the chute 70. The sled 75 maintains pressure on the yarn sausage. A number of thread discs may be positioned about the sled 75 so as to allow the winder 65 to pull the yarn from the sausage. Other components and other configurations may be used herein. As described above, the accumulator 60 acts as a buffer between the heat setting tunnel 35 and the winder 65 so as to avoid line stoppage.

The heat setting line 10 and the accumulator 60 described herein are for purposes of example only. An example of a known heat setting line 10 and accumulator 60 may be the TVP3 heat setting line for carpet yarn and the MAT3 yarn accumulator sold by Superba S.A.S. of Mulhouse, France. Other types of heat setting lines and accumulators may be used herein. Likewise, any type of linear accumulation devices also may be used herein.

Figure 3:
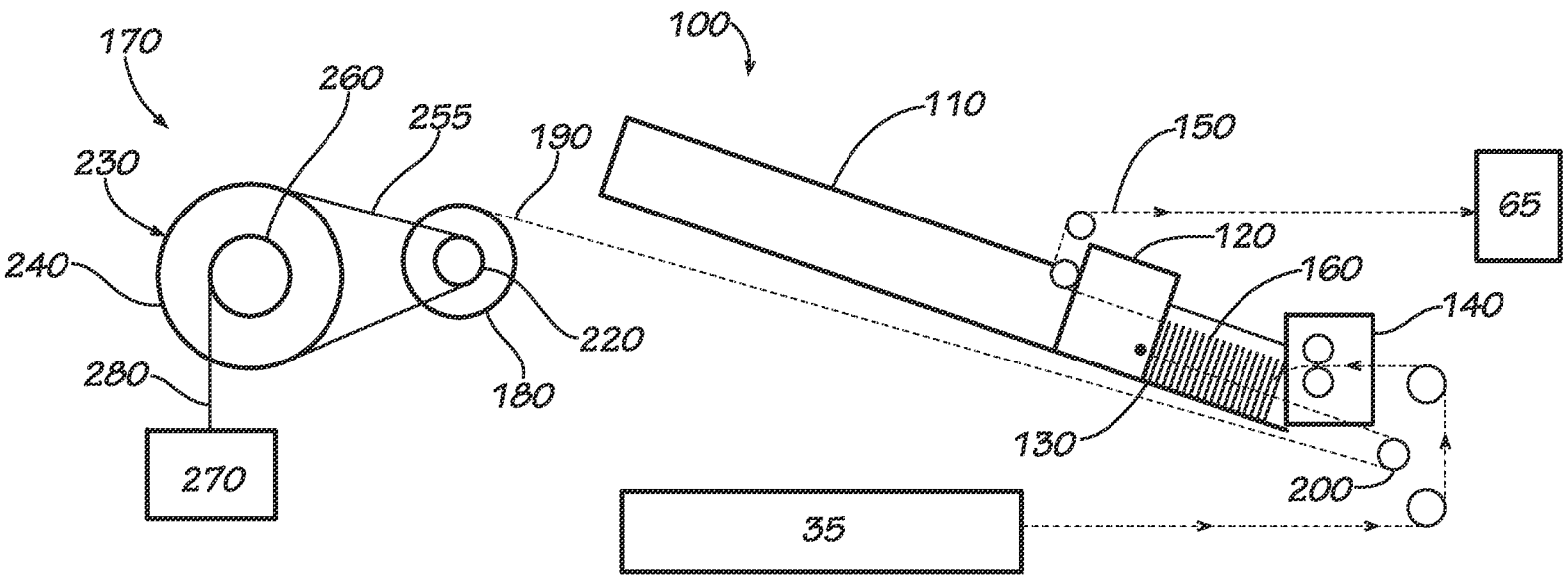
FIG. 3 is a schematic view of a yarn accumulator with a tensioning device as may be described herein.
Figure 4:
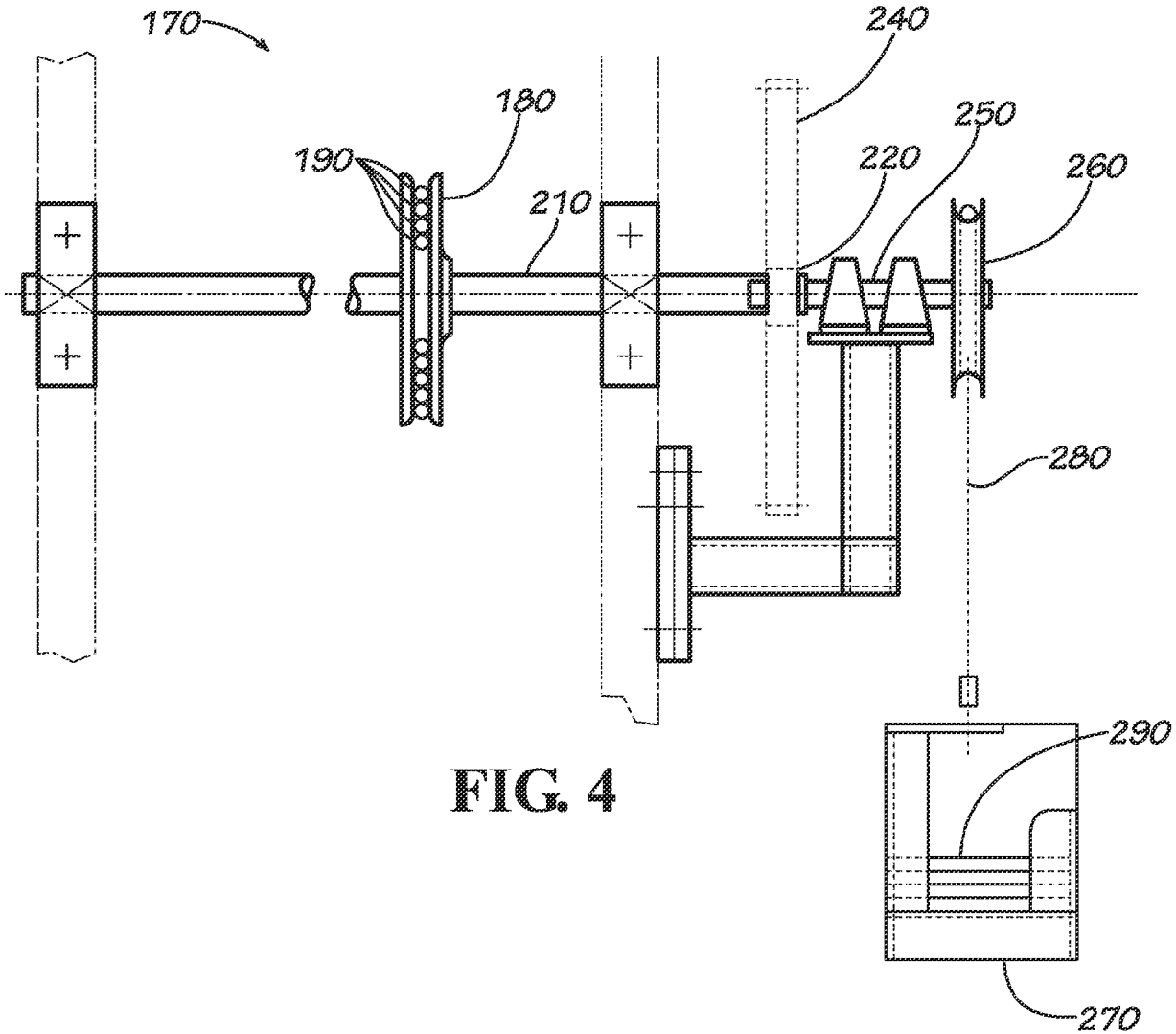
FIG. 4 is a side plan view of the tensioning device of the yarn accumulator of FIG. 3.
Figure 5:
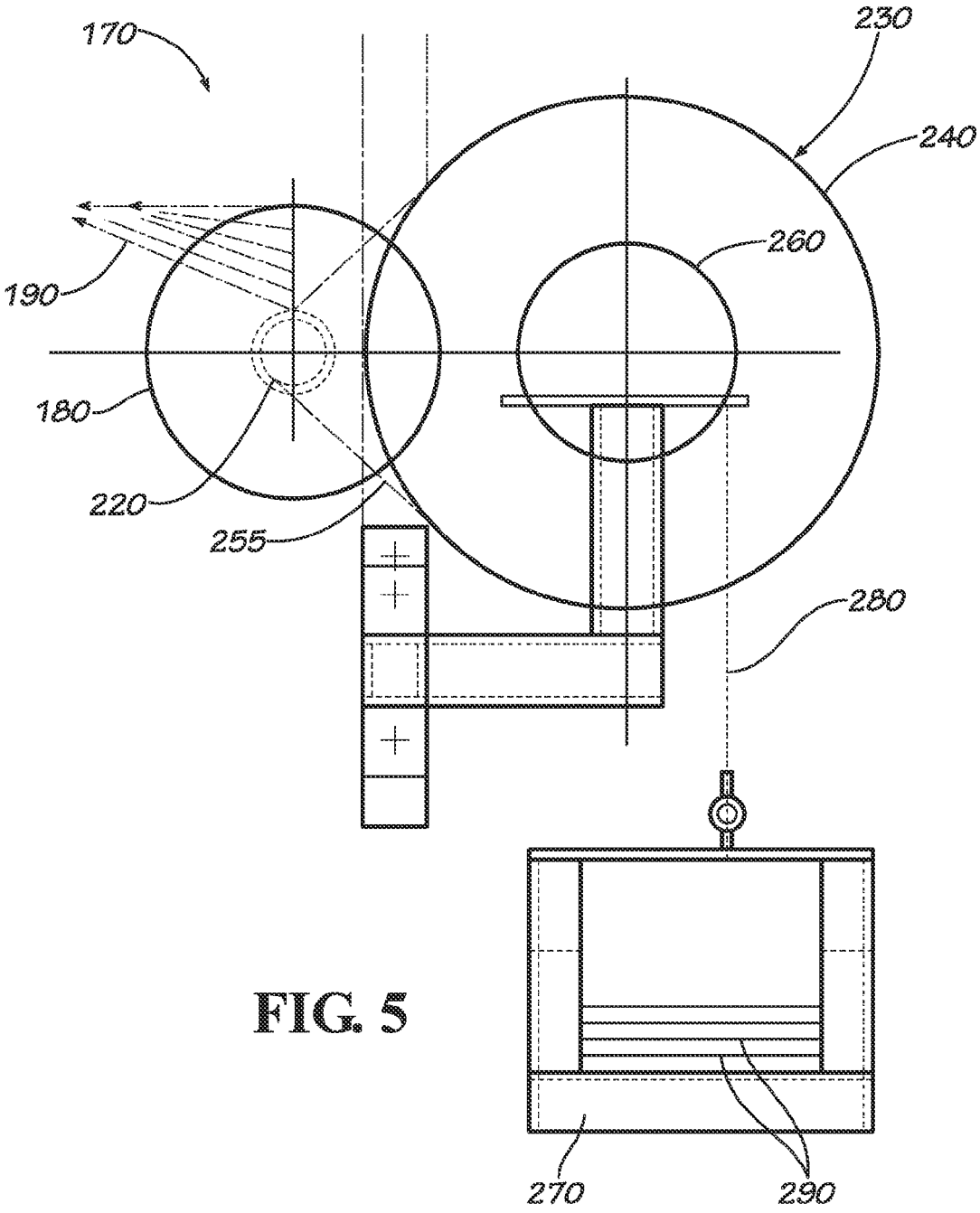
FIG. 5 is a front plan view of the tensioning device of the yarn accumulator of FIG. 3.

FIGS. 3-5 show an accumulator 100 as may be described herein. Similar to the accumulator 60 described above, the accumulator 100 may include a chute 110 with a sled 120 positioned therein. The sled 120 may have one or more thread discs 130 positioned therein. Likewise, a pull roller 140 may be positioned at one end of the chute 110. The accumulator 100 accumulates a continuous length of yarn 150 therein in the form of a yarn sausage 160 as described above, i.e., an expanding or contracting mass of yarn in any form. The accumulator 100 may be in communication with the heat setting tunnel 35 and the winder 65. Other components and other configurations may be used herein.

The accumulator 100 also may include a tensioning device 170. The tensioning device 170 may include a sled pulley 180. The sled pulley 180 may be in communication with the sled 120 of the accumulator 100 via a sled cable 190 and one or more rollers 200. The sled pulley 180 may have a sufficient depth such that multiple coils of the sled cable 190 may be mounted thereon. As the sled cable 190 builds within the sled pulley 180, the ratio therein may change. In this example, the ratio may change about two times although any ratio may be used herein. Likewise, other types of ratio changing devices may be used herein such as a tapered pulley, a tapered drum, and the like.

The sled pulley 180 may be mounted on a sled shaft 210 for rotation therewith. A first pulley 220 of a pulley set 230 also may be mounted on the sled shaft 210. A second pulley 240 of the pulley set 230 may be positioned on a pulley shaft 250 for rotation therewith. The first and second pulleys 220, 240 of the pulley set 230 may be in communication via a pulley coil 255. The first and second pulleys 220, 240 of the pulley set 230 may have a size ratio of about four to one (4:1) or more. In this example, about an eight to one (8:1) size ratio may be used. Any desired size and any desired ratio may be used herein. Likewise, other types of ratioed drive devices may be used herein such as a block and tackle and other types of pulleys and the like.

A counterweight pulley 260 may be positioned on the pulley shaft 250 for rotation therewith. The counterweight pulley 260 may be in communication with a counterweight 270 via a counterweight cable 280. A number of individual weights 290 may be positioned within the counterweight 270 so as to vary the overall weight of the counterweight 270 depending upon the application.

In use, the tensioning device 170 maintains a variable force on the yarn sausage 160 regardless of the expanding or contracting length of the sausage 160. As the sausage 160 expands, the sled pulley 180 pulls the first pulley 220 of the pulley set 230. As such, the first pulley 220 pulls the second pulley 240 and the counterweight pulley 260 to raise the counterweight 270. The pressure or force on the yarn sausage 160 thus increases due to the ratio differences in the sled pulley 180 and the pulley set 230. Likewise, the reverse occurs as the length of the yarn sausage 160 declines and the force thereon is reduced.

The use of the variable depth sled pulley 180 and the variable ratio pulley set 230 thus allows the counterweight 270 to move only a fraction of the length moved by the sled 120. For example, given the eight to one (8:1) size ratio described above, the sled 120 may move about twenty-four (24) feet (about 7.3 meters) while the counterweight 270 moves only about three (3) feet (about 0.9 meters). Moreover, the tensioning device 170 applies the variable tension without the use of electronics, motors, or other types of non-mechanical devices. Further, the overall weight of the counterweight 270 may be varied. As such, any desired ratio or weight may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

I claim:

1. A yarn accumulator for use with a yarn sausage in a heat setting line, comprising:

a sled in contact with the yarn sausage; and a tensioning device which comprises a sled pulley in communication with the sled, a ratioed pulley set in communication with the sled pulley, and a counterweight pulley in communication with the ratioed pulley set, wherein the tensioning device applies a variable tension to the sled based upon a length of the yarn sausage.

2. The yarn accumulator of claim 1, wherein the tensioning device comprises a counterweight in communication with the counterweight pulley.

3. The yarn accumulator of claim 2, wherein the counterweight comprises a plurality of weights.

4. The yarn accumulator of claim 1, wherein a first pulley and a second pulley of the ratioed pulley set comprise a ratio of about four to one or greater.

5. The yarn accumulator of claim 1, wherein a first pulley of the ratioed pulley set comprises a sled shaft.

6. The yarn accumulator of claim 5, wherein a second pulley of the ratioed pulley set comprises a pulley shaft.

7. The yard accumulator of claim 6, wherein the first pulley and the second pulley are in communication via a pulley coil.

8. The yarn accumulator of claim 1, further comprising a chute with the sled thereon.

9. The yarn accumulator of claim 1, further comprising a pull roller positioned about the sled.

10. A yarn accumulator for use with a yarn sausage in a heat setting line, comprising:

a sled in contact with the yarn sausage;

a tensioning device which comprises a sled pulley in communication with the sled and a ratioed pulley set in communication with the sled pulley, wherein:

the ratioed pulley set comprises a first pulley with a sled shaft and a second pulley with a pulley shaft, a counterweight pulley is positioned on the pulley shaft, and the tensioning device applies a variable tension to the sled based upon a length of the yarn sausage.

11. A yarn accumulator for use with a yarn sausage in a heat setting line, comprising:

a sled in contact with the yarn sausage, wherein the sled comprises one or more thread discs thereon; and a tensioning device in communication with the sled, wherein the tensioning device applies a variable tension to the sled based upon a length of the yarn sausage.

12. The yarn accumulator of claim 11, wherein the tensioning device comprises a sled pulley in communication with the sled, a ratioed pulley set in communication with the sled pulley, and a counterweight pulley in communication with the ratioed pulley set.

13. The yarn accumulator of claim 11, further comprising a chute with the sled thereon.

14. The yarn accumulator of claim 13, further comprising a pull roller positioned on an end of the chute.

15. A method of maintaining a force on a yarn sausage in a yarn accumulator, comprising:

positioning a sled about the yarn sausage;

expanding a length of the yarn sausage;

pushing the sled in a first direction by the expanding length of the yarn sausage;

pulling a first pulley of a ratioed pulley set by the sled pushed in the first direction;

pulling a second pulley of the ratioed pulley set by a pulley coil in communication with the first pulley;

raising a counterweight by the second pulley; and pulling the sled in a second direction to maintain the force on the yarn sausage as the counterweight rises.

16. A yarn accumulator for use with a yarn sausage in a heat setting line, comprising:

a sled in contact with the yarn sausage; and a tensioning device in communication with the sled;

the tensioning device comprising a ratioed pulley set and a counterweight such that the tensioning device applies a variable tension to the sled based upon a length of the yarn sausage.

17. The yarn accumulator of claim 16, wherein the tensioning device comprises a sled pulley in communication with the sled.

18. The yarn accumulator of claim 16, wherein the tensioning device comprises a counterweight pulley in communication with the ratioed pulley set and the counterweight.

19. The yarn accumulator of claim 16, wherein the counterweight comprises a plurality of weights.

20. The yarn accumulator of claim 16, wherein a first pulley and a second pulley of the ratioed pulley set comprise a ratio of about four to one or greater.

* * * * *